US007552604B1

(12) United States Patent
Waldrop et al.

(10) Patent No.: US 7,552,604 B1
(45) Date of Patent: Jun. 30, 2009

(54) DOUBLE NEEDLE BAR ELASTOMERIC SPACER KNIT

(75) Inventors: Anthony R. Waldrop, Easley, SC (US); Lynnette Stein, Simpsonville, SC (US); Bernard Smith, Greenville, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 12/082,185

(22) Filed: Apr. 9, 2008

(51) Int. Cl.
*D04B 21/18* (2006.01)

(52) U.S. Cl. ..... 66/195; 66/192; 66/196

(58) Field of Classification Search ..... 66/190, 66/191, 192, 193, 194, 195
See application file for complete search history.

(56) References Cited

U.S. PATENT DOCUMENTS

| | | | | |
|---|---|---|---|---|
| 3,899,900 | A | 8/1975 | Jackson | 66/87 |
| 4,947,528 | A | 8/1990 | Dischler | 26/2 R |
| 5,166,480 | A * | 11/1992 | Bottger et al. | 181/292 |
| 5,385,036 | A * | 1/1995 | Spillane et al. | 66/87 |
| 5,701,846 | A | 12/1997 | Parker, IV | 119/526 |
| 5,807,794 | A | 9/1998 | Knox et al. | 442/306 |
| 5,855,125 | A | 1/1999 | Lohmueller et al. | 66/196 |
| 5,902,753 | A | 5/1999 | DeMott et al. | 442/79 |
| 5,983,470 | A | 11/1999 | Goineau | 28/281 |
| 5,985,961 | A | 11/1999 | Dailey et al. | 524/100 |
| 6,116,059 | A * | 9/2000 | Rock et al. | 66/191 |
| 6,196,032 | B1 * | 3/2001 | Rock et al. | 66/195 |
| 6,199,410 | B1 * | 3/2001 | Rock et al. | 66/195 |
| 6,276,177 | B1 | 8/2001 | West | 66/192 |
| 6,644,070 | B2 * | 11/2003 | Ikenaga et al. | 66/196 |
| 6,688,143 | B2 | 2/2004 | Williams et al. | 66/195 |
| 6,832,419 | B1 | 12/2004 | Williamson et al. | 28/159 |
| 7,060,156 | B2 | 6/2006 | Mack et al. | 156/285 |
| 7,086,423 | B2 | 8/2006 | Keller et al. | 139/21 |
| 7,169,720 | B2 | 1/2007 | Etchells et al. | 442/239 |
| 7,182,989 | B2 | 2/2007 | Higgins et al. | 428/51 |
| 7,213,421 | B2 * | 5/2007 | Shirasaki et al. | 66/193 |
| 7,240,522 | B2 * | 7/2007 | Kondou et al. | 66/195 |
| 7,320,947 | B2 | 1/2008 | Child et al. | 442/110 |
| 7,418,837 | B2 * | 9/2008 | Muller et al. | 66/195 |
| 2002/0102895 | A1 | 8/2002 | Willard | 442/244 |
| 2002/0157429 | A1 * | 10/2002 | Matsumoto | 66/195 |
| 2007/0207691 | A1 | 9/2007 | Cobbett Wiles et al. | 442/318 |

OTHER PUBLICATIONS

Milliken pending U.S. Appl. No. 11/906,734, filed Oct. 3, 2007. Title: "Circular knit fabric and method".

* cited by examiner

*Primary Examiner*—Danny Worrell
(74) *Attorney, Agent, or Firm*—Cheryl J. Brickey

(57) ABSTRACT

A double needle bar spacer knit fabric is provided. The fabric includes a first layer that has a plurality of yarns that are knitted together. At least one of the yarns of the first layer is an elastomeric yarn that functions to impart stretch and recovery properties to the first layer. A second layer that has a plurality of yarns that are knitted together is also present. The first layer and second layer are connected to one another by way of a connecting layer that has a plurality of traversing yarns that are knitted to and extend between both the first layer and the second layer. The first layer provides technical properties to the fabric, and the second layer provides the fabric with desired aesthetic properties.

18 Claims, 4 Drawing Sheets

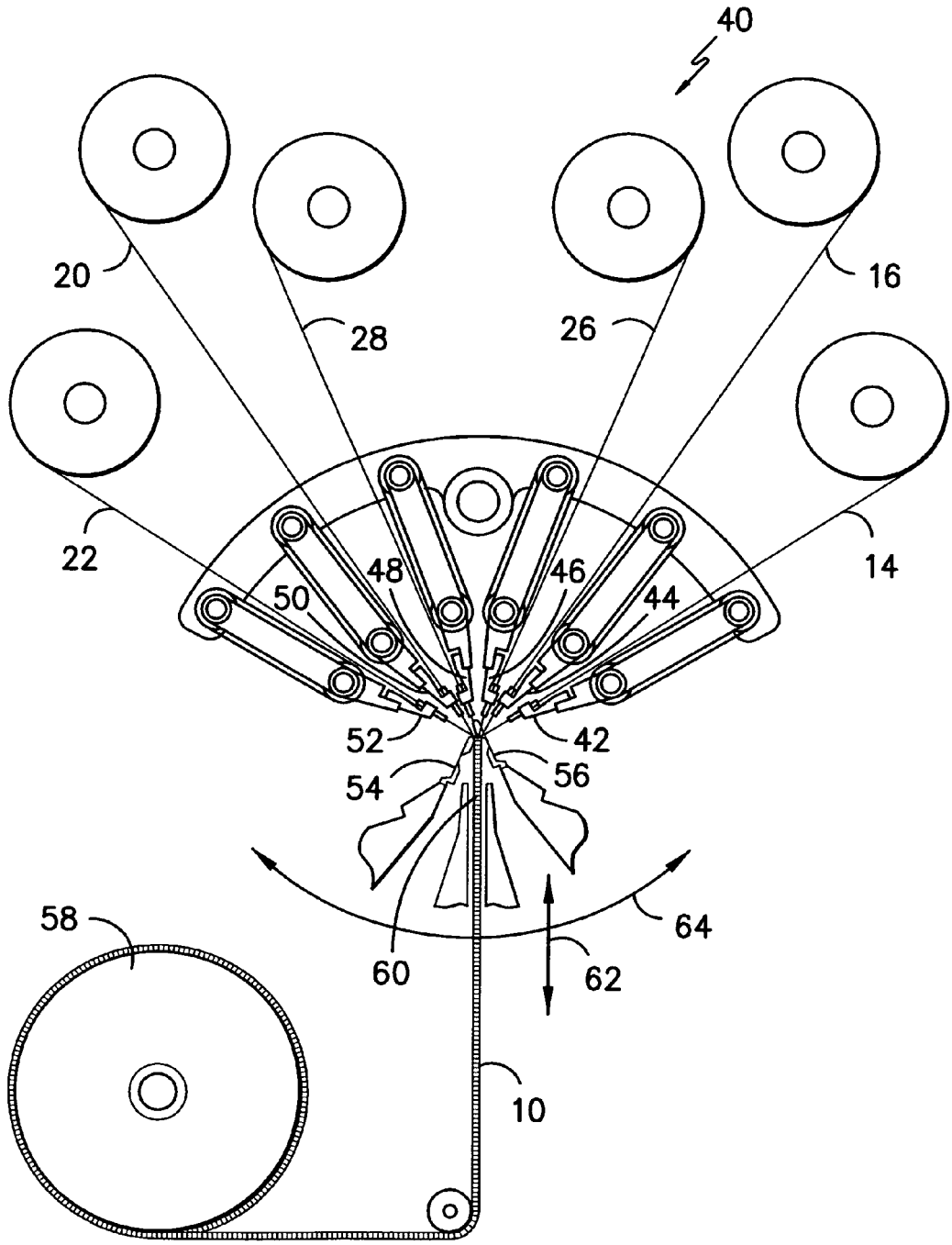
*Fig. –2–*

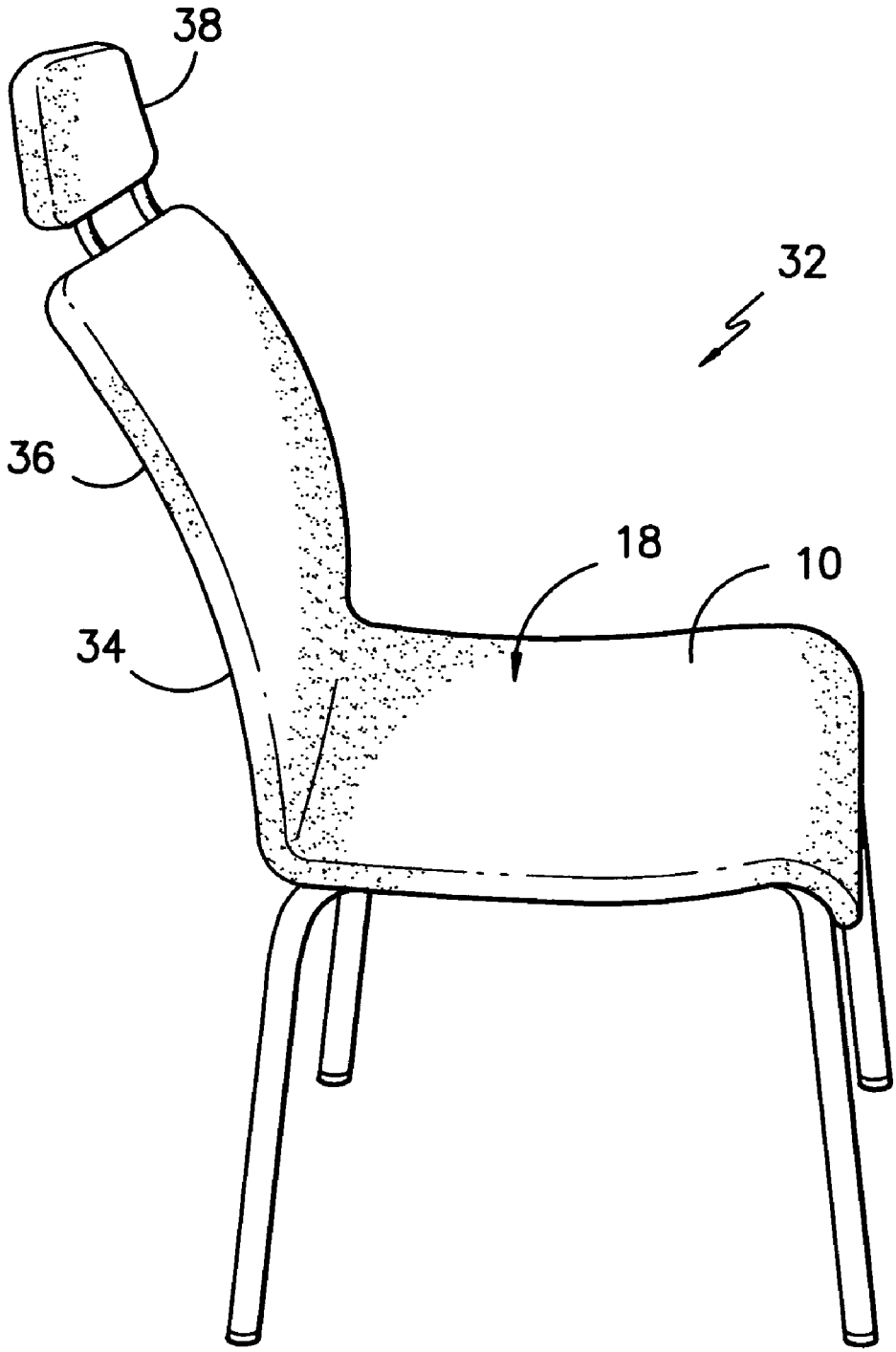
*Fig. –3–*

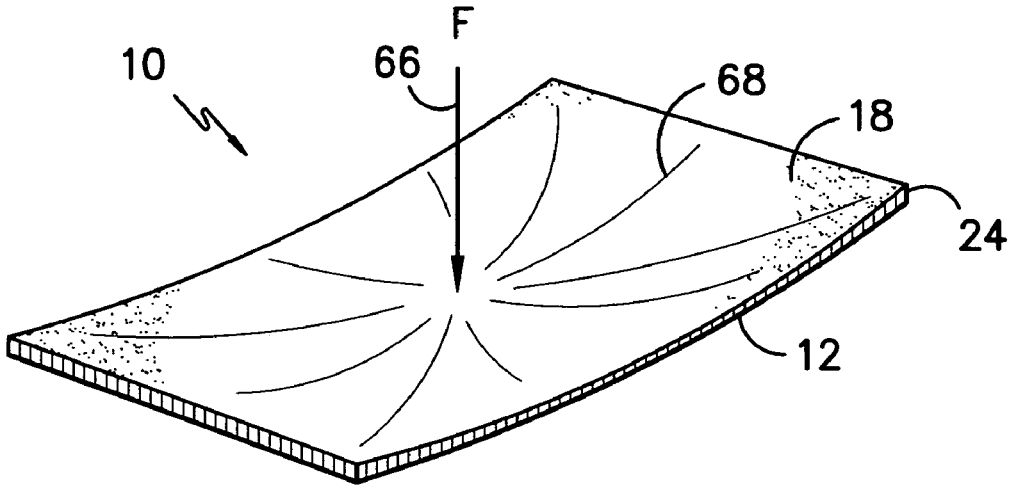
FIG. –4–
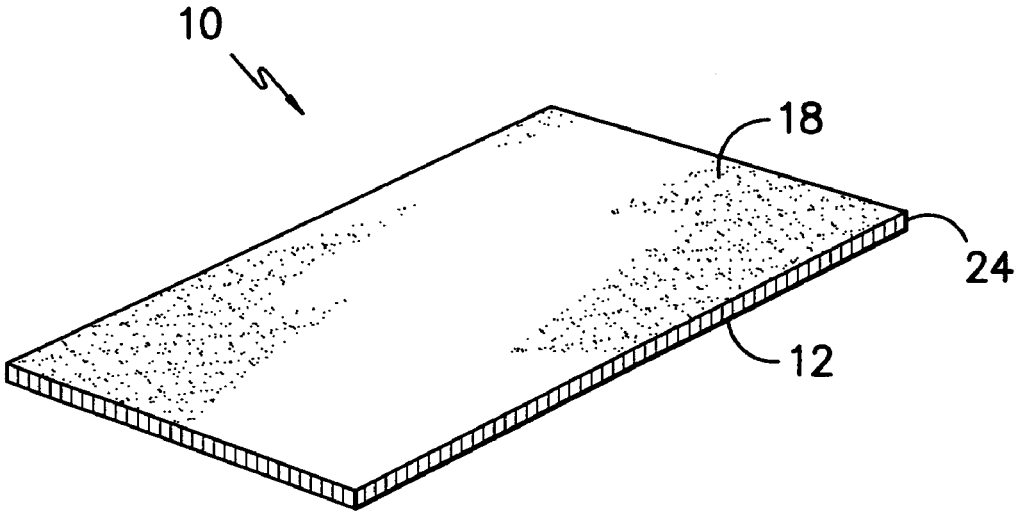
FIG. –5–

DOUBLE NEEDLE BAR ELASTOMERIC SPACER KNIT

BACKGROUND OF THE INVENTION

Knitted fabrics find utility in a variety of personal, residential and industrial applications. For example, knitted fabrics are often incorporated into automotive upholstery due to their aesthetic appearance, feel, and ability to be cleaned. Knitted fabrics are typically more elastic than woven and nonwoven fabrics and may be capable of stretching up to 400% from their relaxed position depending upon the type of material and knitting pattern employed. Significant and repeated loading on the knitted fabric, such as when a driver or passenger sits in the seat of a vehicle, may result in stretching of the knitted fabric to a point at which it cannot fully recover. Over time the knitted fabric may acquire diminished functional and aesthetic properties due to its use in this type of application.

Support systems can be incorporated into automotive seating applications in order to prevent the knitted fabric from being damaged through deformation brought about by repeated use. In this regard, a scrim or backing layer may be applied to the knitted fabric to form a laminate. The scrim functions to prevent excessive stretching of the knitted fabric so that does not become wrinkled or otherwise deformed due to repeated or excessive stress imparted thereto. The laminated knitted fabric and scrim can be subsequently applied to the top of a piece of foam which is in turn installed into the automotive seat. The foam functions to provide support and cushioning to the user of the seat while the knitted fabric functions to provide the seat's aesthetic look and feel.

Automotive seating applications may also employ a tensioning system that is designed to support the weight of the user and provide a desired firmness. The tensioning system can include a wire mesh framework that is tensioned through the use of one or more coil springs. The knitted fabric is supported by the wire framework and again provides the surface that the user contacts when sitting. The tensioning system may impart sufficient tension to the knitted fabric so that the knitted fabric is only stretched a certain amount during use of the automotive seat. Further, the tensioning system imparts elasticity to the knitted fabric so that once weight is removed from the knitted fabric it is drawn back into its initial position. Wrinkles or other imperfections in the knitted fabric are removed through this tensioning so that the knitted fabric maintains a pleasing visual appearance. Although suitable for their intended purposes, additional components and systems incorporated into seating applications with knitted fabrics necessitate additional cost, weight and complexity.

Efforts have been made to incorporate both the necessary aesthetic and functional properties required by an application into a single fabric. This arrangement thus avoids the additional cost, weight and complexity of components and systems that are present in addition to the fabric in the application. For example, an office chair may include a fabric made of a solution dyed textured polyester yarn that is combined with an elastomeric monofilament yarn to form a woven open mesh design. This fabric can then be incorporated into an open frame of the chair to support the weight of the user. The elastomeric monofilament yarn functions to provide suspension and elasticity to the fabric so that it springs back into its original shape after the user's weight is removed. One such office chair that utilizes elastomeric monofilament yarn in its design is an AERON® chair provided by Herman Miller, Inc. having offices located at 855 East Main Avenue, Zeeland, Mich., United States of America.

Although cooler in the summer, the open mesh designs of such chairs do not provided as much warmth in the winter as do office chairs of other types. Further, the elastomeric monofilament yarns in office chairs of this type are contacted by the user when utilizing the chair. Although desirable with respect to strength and durability, elastomeric monofilament yarns in office chairs may cause excess friction on the clothing of a user of the chair. Such friction may function to damage or otherwise accelerate wear of the user's clothing. As such, there remains room for variation and improvement within the art with respect to fabrics used in applications that provide both aesthetic and functional elements.

BRIEF DESCRIPTION OF THE DRAWINGS

FIG. 2 is a schematic view of a method of forming the double needle bar elastomeric spacer knit of FIG. 1.

FIG. 3 is a perspective view of a seating application that incorporates a double needle bar elastomeric spacer knit in accordance with one exemplary embodiment.

FIG. 4 is a perspective view of a double needle bar elastomeric spacer knit with a force applied thereon in accordance with one exemplary embodiment.

FIG. 5 is a perspective view of the double needle bar elastomeric spacer knit of FIG. 4 with the force removed.

DETAILED DESCRIPTION OF THE INVENTION

Figure 1:
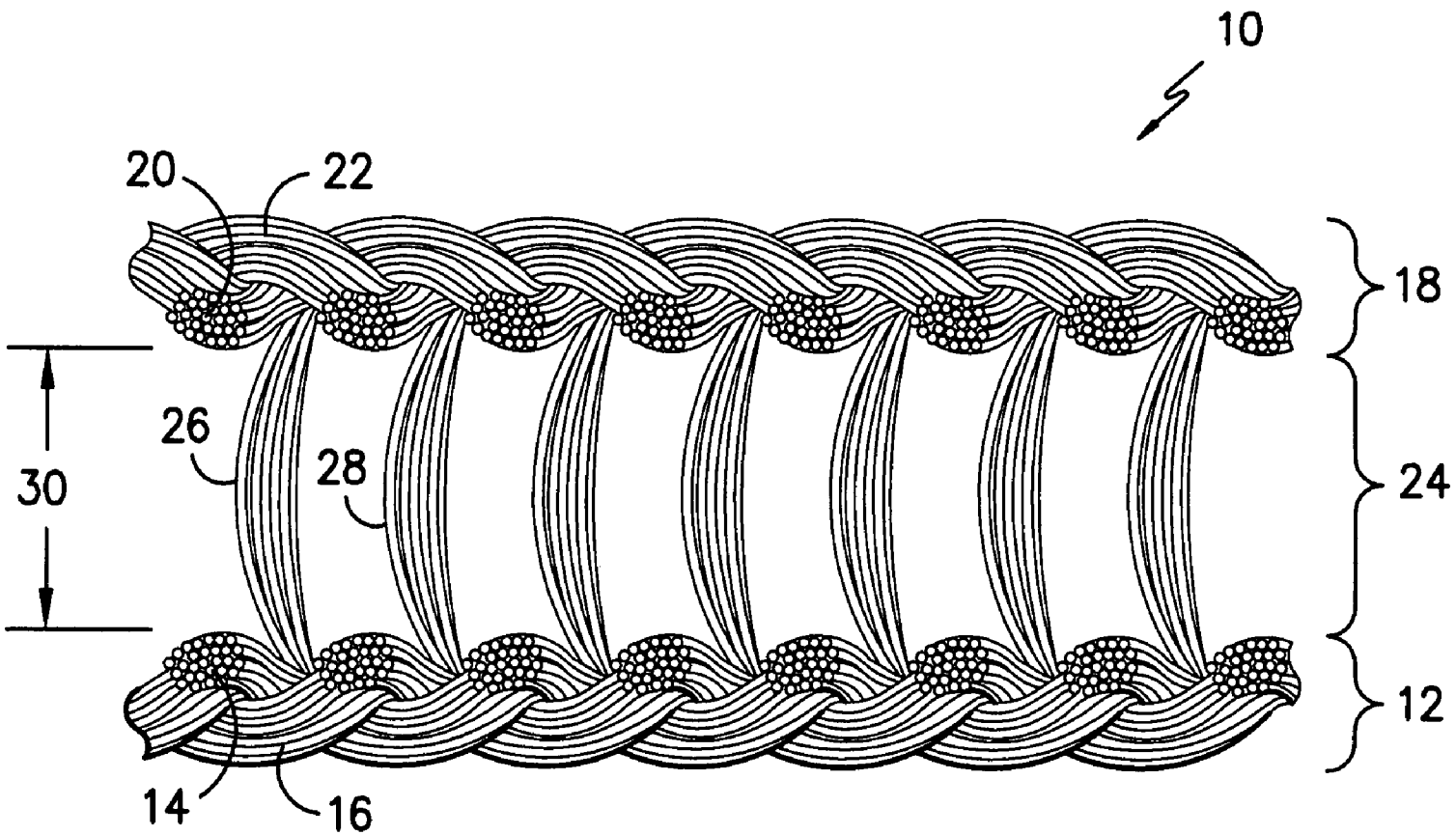
FIG. 1 is a cross-sectional view of a double needle bar elastomeric spacer knit in accordance with one exemplary embodiment.

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

One exemplary embodiment of the present invention provides for a double needle bar spacer knit fabric 10 that includes elastomeric yarns incorporated into a first layer 12 of the fabric 10. The first layer 12 functions as a suspension layer of the fabric 10 in that it pulls other portions of the fabric 10 back to an initial position once an applied force is removed from the fabric 10. The fabric 10 also includes a second layer 18 that is oriented towards the user and possesses a desired aesthetic look and feel. The fabric 10 also includes a connecting layer 24 that is located between the first layer 12 and the second layer 18. The connecting layer 24 functions as a cushion layer to provide a desired feel upon application of force to the fabric 10. The various layers may be formed as a single fabric 10 through a double needle bar knitting machine 40. The fabric 10 may be used in a variety of applications. For example, the double needle bar spacer knit fabric 10 can be used in a seating application 32 found in a residential environment, commercial environment or transportation vehicle.

FIG. 1 is a cross-sectional view of a double needle bar elastomeric spacer knit fabric 10 in accordance with one exemplary embodiment. The fabric 10 includes a first layer 12 that is made from a plurality of knitted yarns 14 and 16. Also included in the fabric 10 is a second layer 18 that is composed of knitted yarns 20 and 22. A connecting layer 24 is interknitted with the first layer 12 and the second layer 18. In this regard, a plurality of traversing yarns 26 and 28 of the connecting layer 24 are connected to both the first layer 12 and the second layer 18 in order to attach these layers 12 and 18 together so as to form a unitary structure.

The first layer 12 and second layer 18 are arranged so as to be generally parallel to one another. The traversing yarns 26 and 28 may extend in a direction generally perpendicular to the planes formed by the first layer 12 and the second layer 18. However, the yarns 26 and 28 need not extend in a generally perpendicular direction to the layers 12 and 18 in accordance with certain exemplary embodiments. The arrangement of the layers 12, 18 and 24 results in the double needle bar spacer knit fabric 10 having a three-dimensional quality and provides some degree of compressibility and resiliency across the fabric 10. The amount of compressibility and resiliency imparted to the fabric 10 may be selected at least in part due to the particular characteristics and number of traversing yarns 26 and 28 that are employed. The space 30 present between the first layer 12 and the second layer 18 may be selected so that the overall thickness of the structure ranges from as little as 1 to 2 millimeters to as much as 25 to 30 millimeters. In accordance with other exemplary embodiments, the space 30 may be selected so that the fabric 10 has a thickness that is from 2 millimeters to 12 millimeters.

The fabric 10 is constructed through an automated double needle bar knitting process. The resulting arrangement of yarns in the fabric 10 includes rows of yarn that follow a relatively loopy path. In this regard, the loops of one row are pulled through the loops of an adjacent row. The resulting structure of a knitted layer of the fabric 10 has a pattern of yarn that does not lie in a single, straight line. This arrangement allows the knitted layer to be capable of stretching in multiple directions should the yarn itself be capable of stretching.

The yarn making up the fabric 10 may be made from a variety of materials. For example, the yarn may be a synthetic material such as polyester, acrylic, nylon or olefin. Further, the yarn may be either spun or filament textured or filament oriented in construction. The yarn may also be made of natural fibers in accordance with certain exemplary embodiments. For example, the yarn may be cotton or wool fibers in accordance with certain versions of the fabric 10. Still further, the yarn may be made of modified natural materials such as rayon or acetate in yet other exemplary embodiments. It is to be understood that the aforementioned materials making up yarn are only exemplary and that others may be employed as appropriate. The yarn may be either a monofilament yarn or a multifilament yarn in accordance with certain exemplary embodiments. Multifilament yarns are formed from a multiplicity of discrete filaments that are combined together in a defined manner to yield a desired yarn construction with a predefined cross-sectional geometry and diameter. A monofilament yarn is made of a single, usually untwisted, filament.

A double needle bar knitting machine 40 that may be used to construct the double needle bar spacer knit fabric 10 is illustrated in schematic view in FIG. 2. The double needle bar knitting machine 40 may be of the Raschel type. However, it is to be understood that other types of knitting machines 40 may be employed in order to construct the double needle bar spacer knit fabric 10 in accordance with other exemplary embodiments. A first pair of cooperating yarns 14 and 16 are fed by guide bars 42 and 44 to the fabric 10 formation zone. A second pair of cooperating yarns 20 and 22 are likewise delivered to the fabric 10 formation zone by a pair of guide bars 50 and 52. The first pair of yarns 14 and 16 are used to construct the first layer 12 of the fabric 10, and the second pair of yarns 20 and 22 make up the second layer 18. Concurrently with the formation of the first layer 12 and the second layer 18, the traversing yarns 26 and 28 are delivered to the fabric 10 formation zone and are passed back and forth between the first and second layers 12 and 18 to form a sandwich structure. The traversing yarns 26 and 28 thus make up the connecting layer 24 of the fabric 10. The traversing yarn 26 is fed by a guide bar 46, and the traversing yarn 28 is fed by a guide bar 48.

The guide bars 42, 44, 46, 48, 50 and 52 are mounted on a swingable frame for traversing back and forth in a path transverse to a pair of latch needles 54 and 56. The path of motion of the guide bars 42, 44, 46, 48, 50 and 52 is illustrated as direction 64. Each one of the guide bars 42, 44, 46, 48, 50 and 52 can reciprocate on the swingable frame in parallelism with the axis of the latch needles 54 and 56. Controlled movement of the guide bars 42, 44, 46, 48, 50 and 52 can be achieved through the use of a pattern chain that is carried by a pattern drum. The latch needles 54 and 56 may move up and down in direction 62 so as to engage the various yarns 14, 16, 20, 22, 26 and 28 and loop them about one another to form a knitted structure. The double needle bar knitting machine 40 may have a gauge of thirty two so that sixteen latch needles 54 and sixteen latch needles 56 are present per every inch of length of the machine 40. However, the machine 40 may have varying gauges in accordance with other exemplary embodiments. The particular knitting construction may be achieved through varying the movements of the guide bars 42, 44, 46, 48, 50 and 52 along with the latch needles 54 and 56 as desired. Further, a gap 60 between the latch needles 54 and 56 may be selected of a particular magnitude so that the resulting double needle bar spacer knit fabric 10 has a desired thickness.

The fabric 10 is not split through its center to form a pair of ground fabrics that each have a pile surface. Instead, after leaving the fabric formation zone the sandwich construction of the fabric 10 remains in place as is desired for its intended application. Once constructed, the double needle bar spacer knit fabric 10 can be transported and formed into a roll 58. In accordance with one exemplary embodiment.

The yarn 14 and 16 making up the first layer 12 may be elastomeric yarn so as to provide a stretch and recovery property to the first layer 12. Elastomeric yarn as used herein means a nontextured yarn that can be stretched at room temperature to at least seventy-five percent (75%) over its original length and which after removal of the tensile force will immediately and forcibly return to within ten percent (10%) of its original length. To determine if a yarn is elastomeric, ASTM Standard Test Method for Permanent Deformation of Elastomeric Yarns (D 3106-95a) can be used. The ASTM Standard Test Method for Permanent Deformation of Elastomeric Yarns (D 3106-95a) is incorporated by reference herein in its entirety for all purposes. The aforementioned test method may be modified from the disclosed protocol in that the specimen for purposes of the test may be stretched to a length of seventy five percent (75%) over the original length of the specimen for all stretching time periods. The elongation after stretch is determined after the longer relaxation time period.

Examples of elastomeric yarns are yarns formed of phthalate-based polyesters used to provide the stabilized monofilaments are linear and cyclic polyalkylene terephthalates, particularly polyethylene terephthalate (PET) polypropylene terephthalate (PPT) polybutylene terephthalate (PBT), ethylene-1,4-cyclohexylenedimethylene terephthalate (PETG), and random or block copolymers thereof contain one or more of the above components. Examples of elastomeric yarn that can be used in the present fabric 10 are at those set forth in U.S. Pat. No. 5,985,961, entitled Monofilament, and issued to Dailey et al. on Nov. 16, 1999, the entire contents of which are incorporated by reference herein in their entirety for all purposes. The elastomeric yarn in fabric 10 can be a monofilament or a multifilament, and have a size from about 80 denier to about 6000 denier per filament. The elastomeric yarn in the present invention can also be a core/sheath type yarn.

The elastomeric yarn can be colored in the process of forming the yarn, such as solution dying, causing the colorant material to be distributed evenly throughout the cross section of the yarn. The elastomeric yarn can also be dyed after the formation of the yarn, or after the formation of the fabric 10, in a yarn dye or piece dye process. In one embodiment, the elastomeric yarn can also include a flame retardant agent. The elastomeric yarn can also include an ultra-violet (UV) inhibitor. Examples of UV inhibitors includes benzotriziazole derivatives, benzotriazine derivatives, benzoxazinones derivatives, benzophenones derivatives, benzoates derivatives, hindered amines, or the like.

The fabric 10 may include non-elastomeric yarns. These non-elastomeric yarns may be polymeric and can include polyester yarns, nylon yarns, acrylic yarns, blends thereof, or the like. The non-elastomeric polymeric yarns can be monofilament, multifilament, staple, textured, or the like. The non-elastomeric polymeric yarn can be colored in the process of forming the yarn, such as solution dying, causing the colorant material to be distributed evenly throughout the cross section of the yarn. The non-elastomeric polymeric yarn can also be dyed after the formation of the yarn or the fabric. The non-elastomeric polymer yarn can also include an ultra-violet (UV) inhibitor similar to the UV inhibitors described in association with the elastomeric yarn.

In accordance with various exemplary embodiments, the yarns 14 and 16 of the first layer 12 may be RITEFLEX® multifilament copolyester yarn which may be provided by Ticona UK Ltd. having offices at Hollinswood House, Stafford Court, Telford, United Kingdom. Alternatively, the yarns 14 and 16 may be HYTREL® multifilament copolyester yarn which can be provided by E.I. Du Pont De Nemours & Company having offices at 1007 Market St., Wilmington, Del., USA. The yarns 14 and 16 may also be elastomeric yarns that can be incorporated into a fabric marketed under the trademark MFLEX® by Milliken & Company having offices located at 920 Milliken Road, Spartanburg, S.C., USA. Use of the aforementioned materials may result in a first layer 12 that can stretch and recover in essentially all directions. In accordance with other exemplary embodiments, the yarns 14 and 16 may be a bicomponent elastomeric yarn. One such yarn is a bicomponent sheath/core elastomeric monofilament yarn as disclosed in U.S. Pat. No. 5,807,794. The entire contents of U.S. Pat. No. 5,807,794 are incorporated by reference herein in their entirety for all purposes.

The elastomeric yarns 14 and 16 of the first layer 12 may have an elongation to break of up to seventy percent (70%), of up to ninety percent (90%), or of up to one hundred percent (100%) in accordance with various exemplary embodiments. The elastomeric yarns 14 and 16 may have a linear density from 10 to 1000 denier in accordance with various exemplary embodiments. In accordance with one embodiment, the yarns 14 and 16 are 700 denier multifilament with 40 filaments (700/40). Any number of the yarns 14 and 16 may be elastomeric yarns. For example, all of the yarns 14 and 16 of the first layer 12 are elastomeric yarns in certain versions of the fabric 10. In other embodiments of the fabric 10, half of the yarns 14 and 16 are elastomeric yarns while the other half the yarns 14 and 16 are non-elastomeric yarns. The elastomeric yarns 14 and 16 may constitute up to twenty five percent (25%) of the total weight of the resulting fabric 10. In other exemplary embodiments, the elastomeric yarns 14 and 16 may be up to fifty percent (50%) or may be up to sixty percent (60%) of the total weight of the fabric 10. The yarns 14 and 16 may impart stretch and recovery properties to the first layer so that it is capable of recovering up to ninety percent (90%), up to ninety five percent (95%), or up to one hundred percent (100%) of its initial shape after being stretched or otherwise deformed.

The first layer 12 is a technical layer of the double needle bar spacer knit fabric 10 in that stretch and recovery properties of the first layer 12 are imparted to other layers of the fabric 10 such as the second layer 18 and the connecting layer 24. All of the stretch and recovery ability of the first layer 12 can be imparted to the other layers 18 and 24. In other arrangements, only a portion of the stretch and recovery ability of the first layer 12 may be imparted to the rest of the fabric 10. In this regard, the other portions of the fabric 10 may be made a material or knit construction that inhibits their complete recovery after stretching or deformation. As such, the double needle bar spacer knit fabric 10 may recover the same amount as the first layer 12 would individually after being stretched, or the fabric 10 may recover a lesser amount than the first layer 12 would individually after being stretched.

The second layer 18 is an aesthetic layer of the double needle bar spacer knit fabric 10. The yarns 20 and 22 making up the second layer 18 may be made from a variety of materials and have various constructions in order to achieve desired characteristics. In accordance with one exemplary embodiment, the yarns 20 and 22 may be textured polyester yarns with a linear density from 20 to 150 denier. In accordance with further exemplary embodiments, the linear density of the yarns 20 and 22 may be up to 300 denier. The yarns 20 and 22 of the second layer 18 may be selected so that the second layer 18 is soft to the touch and does not abrade the clothing of users that sit or rub against the second layer 18. Once formed, the second layer 18 may be dyed or printed as desired. Additionally or alternatively, the yarns 20 and 22 making up the second layer 18 can be dyed a desired color before formation of the second layer 18. The yarns 20 and 22 selected for use in the second layer 18 may be multifilament yarns and/or monofilament yarns and may be made out of any material in various knit patterns so as to achieve a desired look, feel, strength, water resistance or other property. Although one or more of the yarns 20 and 22 may be elastomeric yarns, in accordance with one exemplary embodiment none of the yarns 20 and 22 of the second layer 18 are elastomeric yarns. The second, aesthetic layer 18 may have a knit pattern and look that is similar to that of the first, technical layer 12. Alternatively, the first layer 12 and second layer 18 may have different constructions so that they have different appearances. For example, the first, technical layer 12 may have a smooth appearance, and the second, aesthetic layer 18 can be produced with mesh holes to result in a distinctly different appearance than the first layer 12.

The traversing yarns 26 and 28 of the connecting layer 24 may be made from a variety of materials. For example, the traversing yarns 26 and 28 may be made of polyester, nylon, acrylic, polypropylene, spandex, polylactic acid, rayon, or any combination of these materials in accordance with various exemplary embodiments. The connecting layer 24 may be arranged so as to function as a cushion layer of the double needle bar spacer knit fabric 10 for the purposes of absorbing shock and imparting a desired give when pressed upon by a user. In one embodiment, the traversing yarns 26 and 28 may be made of polyester monofilament and be generally thick with fibers being from thirty (30) to seventy (70) denier in order to resist crushing. Monofilament polyester yarn may be lightweight, air-permeable, and may provide ease of fabrication. Further, this type of yarn may have good colorability and inherent antimicrobial functionality due to its hydrophobic nature. In other exemplary embodiments, the yarns 26 and 28 may be all multifilament yarns or a combination of both multifilament yarns and monofilament yarns. In another example, the yarns 26 and 28 are textured polyester multifilament yarns with seventy (70) denier having thirty six (36) filaments per yarn. In accordance with certain exemplary embodiments, none of the yarns 26 and 28 are elastomeric. However, other embodiments exist in which one or more of the yarns 26 and 28 are elastomeric.

Although described as being made of particular materials and having various properties, the yarns of the various layers 12, 18 and 24 of the double needle bar spacer knit fabric 10 may be provided as discussed above with respect to any of the layers 12, 18 or 24. In accordance with one exemplary embodiment, the yarns 14 and 16 of the first layer 12 are RITEFLEX® co-polyester elastomeric yarn having one ply yarn, 800 denier with 40 filaments per yarn (1/800/40). The yarns 20 and 22 of the second layer 18 may be textured polyester yarns having one ply, 150 denier with 36 filaments per yarn (1/150/36). The traversing yarns 26 and 28 of the connecting layer 24 can be textured polyester yarns with one ply, 70 denier with 36 filaments per yarn (1/70/36). The yarns 20, 22, 26 and 28 can be textured polyester yarns provided by Nan Ya Corporation having offices at 9 Peach Tree Hill Road, Livingston, N.J., USA. The fabric in this exemplary embodiment may be made by a double needle bar knitting machine 40 having a gauge of thirty two. As such, various exemplary embodiments exist in which elastomeric yarns can be incorporated into both the first layer 12 and the second layer 18. Additionally, the traversing yarns 26 and 28 may also include elastomeric yarn so that the connecting layer 24, first layer 12 and second layer 18 all include elastomeric yarn.

The double needle bar spacer knit fabric 10 may be incorporated into a seating application 32 as shown with reference to FIG. 3. The seating application 32 may be used in an automobile, an airplane, a train, or in an office or home environment. The actual design of the seating application 32 may be varied as desired depending upon environment of use and aesthetic preferences. However, the seating application 32 generally includes a seat frame 34 that has a back support 36. A head rest 38 may also be incorporated into the seat frame 34 if desired. The double needle bar spacer knit fabric 10 can be applied to the seat frame 34 so that the aesthetic, second layer 18 is visible and can be contacted by the user of the seating application 32. The fabric 10 can be stretched over the seat frame 34 so that some degree of tension is imparted to the fabric 10 in the at rest position when the seating application 32 is not used. In other exemplary embodiments, the fabric 10 can be applied to the seat frame 34 so that it is not tensioned in an at rest position. The fabric 10 can be attached to or incorporated into the seating application 34 in a variety of manners. For example, the fabric 10 can be attached to the seat frame 34 through the use of adhesives or mechanical fasteners in accordance with certain exemplary embodiments. Additionally or alternatively, the fabric 10 may be molded into the seat frame 34 or attached through a snap-fit engagement. The fabric 10 may be applied as a single piece to the entire desired surface area of the seat frame 34 or may be multiple pieces that are attached thereto. The head rest 38 may also include the fabric 10 or may be made of another material in other arrangements.

The fabric 10 is arranged so that the second layer 18 is presented to the user of the seating application 32. The second layer 18 is formed with desired aesthetic qualities so that the fabric 10 presents the user with a pleasing feel, softness, color, and overall look. The first layer 12 and connecting layer 24 may be completely hidden from view by the second layer 18 in certain embodiments. In other embodiments, the entirety or portions of the first layer 12 and/or the connecting layer 24 may be capable of being viewed by the user along with the second layer 18 to achieve a desired aesthetic look and feel. The connecting layer 24 functions to provide an impact resistance or cushion property to the seating application 32. In this regard, force imparted onto the fabric 10 through weight of the user will act to compress the connecting layer 24 which in turn will push back against the user so that a cushioning feel is imparted when sitting in the seating application 32. The cushioning feature of the connecting layer 24 may eliminate the need to incorporate a foam cushion into the seating application 32 thus resulting in a lighter, less expensive, more robust and better performing product.

The first layer 12 functions as a technical layer of the fabric 10. The stretch and recovery properties of the first layer 12 imparted through the elastomeric yarns 14 and/or 16 acts to provide a suspension system to the fabric 10. The first layer 12 is primarily or completely against the seat frame 34 such that it acts as a base for the second layer 18 and the connecting layer 24 that are generally further from or not contacting the seat frame 34. The first layer 12 imparts strength to the fabric 10 and functions to draw the other portions of the fabric 10 back into a desired position once the weight of the user is removed from the seating application 32. The second layer 18 and the connecting layer 24 may be stretched out of their initial position once weight is applied to the seating application 32 through normal use. After the weight is removed, the stretch and recovery properties of the first layer 12 function to draw the second layer 18 and the connecting layer 24 back into their initial, at rest position. As such, the aesthetic features provided by the second layer 18 are maintained after repeated cycles of weight application and removal. Incorporation of the elastomeric yarns 14 and 16 into the first layer 12 to cause the first layer 12 to function as a suspension layer removes the necessity of incorporating coil springs or the like into the seating application 32. The first layer 12 thus saves weight, is less costly, more robust and better performing than similar seating applications that include equivalent suspension systems that have coil springs, wire mesh frameworks, or other additional components.

FIGS. 4 and 5 illustrate the functionality of the first layer 12 as a suspension system in accordance with one exemplary embodiment. FIG. 4 shows a double needle bar spacer knit fabric 10 that has a first layer 12, second layer 18, and connecting layer 24 as previously discussed. A force 66 is applied to the second layer 18 that is an aesthetic layer of the fabric 10. The force 66 deforms the second layer 18 some amount and causes stress marks 68 to appear in the second layer 18 that detract from the appearance of the second layer 18. The stress marks 68 may be areas in which the yarns 20 and 22 composing the second layer 18 are pushed aside thus causing an inconsistency in the pattern making up the second layer 18. The stress marks 68 may alternatively be wrinkles formed in the second layer 12 again through force 66 imparted on the fabric 10.

FIG. 5 shows the fabric 10 after the force 66 has been removed such as when a user stands up from the seating application 32. The stretch and recovery ability of the first layer 12 draws the second layer 18 and the connecting layer 24 back into an initial position or back to a position approaching the initial position. This return causes the stress marks 68 to disappear since the aesthetic second layer 18 is returned to its initial at rest position. The fabric 10 may be capable of stretch and recovery in essentially all directions along the planes of the first layer 12 and second layer 18. The connecting layer 24 may also function to bounce back to restore the space 30 present before the force 66 was imparted. Additionally or alternatively, the stretch and recovery ability of the first layer 12 may act to pull the connecting layer 24 back into its initial, at rest position once the force 66 is removed from the fabric 10.

The fabric 10 may be constructed so as to exhibit substantial resistance to repeated displacements to exhibit good stretch and recovery from stretch. The fabric 10 may be classified as a load bearing fabric 10 in that is it capable of sustaining highly repetitive deflections with good recovery while retaining its shape. The fabric 10 may also be described as being a "support" fabric in that it is capable of bearing a load that is equivalent to all or a portion of one or more persons' body weight without the use of mechanical supporting materials. In this regard, a conventional foam backing and/or mechanical springs or foam systems need not be employed in certain exemplary embodiments.

The double needle bar elastomeric spacer knit fabric 10 thus incorporates the aesthetic surface and technical layer present in current seating applications into a single fabric. The fabric 10 combines the three dimensional properties of a spacer knit fabric with the stretch and recovery abilities of an elastomeric mesh fabric. The fabric 10 provides a single fabric that creates a desired surface geometry, pleasing aesthetic features, and a suspension system for use in a seating application 32 through the use of elastomeric yarn.

The fabric 10 can be subjected to various treatments or agents in order to have various desirable properties imparted thereto. For example, the first layer 12, second layer 18 and/or the connecting layer 24 can be treated with an anti-bacterial, anti-fungal or anti-microbial agent such as that marketed under the trademark ALPHASAN® which is provided by Milliken & Company having offices located at 920 Milliken Road, Spartanburg, S.C., USA. Such agent may be applied to one or more of the individual yarns prior to fabric 10 formation, or the agent may be applied after the double needle bar spacer knit fabric 10 has been formed. The anti-microbial agent marketed under the trademark ALPHASAN® is a silver zirconium phosphate anti-microbial agent. Use of an anti-microbial agent or the like may impart a degree of odor control to the fabric 10.

In certain exemplary embodiments, a dust repellant feature may be incorporated into the fabric 10. In one particular embodiment, the fabric 10 may receive a treating composition that includes a fluorochemical that acts as a repellent. The fluorochemical finish may impart stain resistance to the fabric 10 and can repel water and/or oil. Further, the fabric 10 may be constructed so as to have static dissipative qualities in order to reduce or remove electric shocks imparted to the user after exiting the seating application 32. In this regard, the fabric 10 can be given an electrically conductive surface through application of one or more of the layers 12, 18 and/or 24 with an electrically conductive coating in a particular pattern. One such manner of providing a static dissipative feature may be provided as that shown and described in U.S. Pat. No. 7,320,947 B2, the entire contents of which are incorporated by reference herein in their entirety for all purposes.

Exemplary embodiments of the subject matter are described in this application, including the best mode known to the inventors for carrying out the claimed subject matter. Variations of those embodiments may become apparent to those of ordinary skill in the art upon reading the description. The seating application 32 described is but a featured embodiment and application for the fabric 10, and it is to be understood that the fabric 10 could be used in a similar manner on sofas, couches, love seats, subways, airplanes, trains, rail cars, automobiles, dining chairs, conference chairs, residential chairs, and in commercial office or home furniture of other types, without limitation. The inventors expect skilled artisans to employ such variations as appropriate, and the inventors intend for the subject matter described herein to be practiced otherwise than as specifically described in this text. Accordingly, this disclosure includes all modifications and equivalents of the subject matter recited in the claims. Moreover, any combination of the above-described elements in all possible variations thereof is encompassed by the present disclosure unless otherwise indicated.

The invention claimed is:

1. A double needle bar spacer knit fabric, comprising:

a first layer having plurality of yarns that are knitted together, wherein at least one of the yarns of the first layer is an elastomeric yarn that functions to impart stretch and recovery properties to the first layer;

a second layer having a plurality of yarns that are knitted together; and a connecting layer that has a plurality of traversing yarns that are knitted to and extend between both the first layer and the second layer, wherein all of the yarns of the first layer are elastomeric, and wherein none of the yarns of the second layer are elastomeric.

2. The double needle bar spacer knit fabric as set forth in claim 1, wherein all of the traversing yarns of the connecting layer are polyester monofilament yarns.

3. The double needle bar spacer knit fabric as set forth in claim 1, wherein the first layer has greater stretch and recovery properties than the second layer.

4. The double needle bar spacer knit fabric as set forth in claim 1, wherein the elastomeric yarn of the first layer has an elongation to break of at least 90 percent.

5. The double needle bar spacer knit fabric as set forth in claim 1, wherein the second layer is hydrophobic such that water is prevented from being absorbed through the second layer and into the connecting layer that is between the first layer and the second layer.

6. A double needle bar spacer knit fabric, comprising:

a first layer having plurality of yarns that are knitted together, wherein at least one of the yarns of the first layer is an elastomeric yarn that functions to impart stretch and recovery properties to the first layer;

a second layer having a plurality of yarns that are knitted together; and a connecting layer that has a plurality of traversing yarns that are knitted to and extend between both the first layer and the second layer, wherein the yarns of the first layer are co-polyester yarns having 1 ply, 800 denier, and 40 filaments per yarn; wherein the yarns of the second layer are textured polyester yarns having 1 ply, 150 denier, and 36 filaments per yarn; and wherein the traversing yarns are textured polyester yarns having 1 ply, 70 denier, and 36 filaments per yarn.

7. The double needle bar spacer knit fabric as set forth in claim 1, wherein the elastomeric yarn of the first layer is a multi-filament elastomeric yarn, and wherein the connecting layer functions to separate the first layer and the second layer so that a space is formed between the first layer and the second layer into which the traversing yarns are located.

8. The double needle bar spacer knit fabric as set forth in claim 1, further comprising an antimicrobial agent that is applied to at least one of the layers.

9. A double needle bar spacer knit fabric configured for use in a seating application, comprising:

an aesthetic layer made from a plurality of yarns, wherein the aesthetic layer is capable of being viewed and contacted by a user of the seating application and is of a desired look and feel;

a cushion layer made from a plurality of yarns, wherein the cushion layer is located adjacent the aesthetic layer and is configured to compress when force is applied to the aesthetic layer and transferred to the cushion layer; and a suspension layer made from a plurality of yarns, wherein at least some of the yarns of the suspension layer are elastomeric yarns, wherein the suspension layer is located adjacent the cushion layer such that the cushion layer is located between the aesthetic layer and the suspension layer, wherein the suspension layer is configured to stretch when force is applied thereto and recover to an initial position after force is removed therefrom;

wherein the aesthetic layer, the cushion layer and the suspension layer are made in a double needle bar construction.

10. The double needle bar spacer knit fabric as set forth in claim 9, wherein the aesthetic layer, the cushion layer and the suspension layer are incorporated into a seat frame.

11. The double needle bar spacer knit fabric as set forth in claim 10, wherein the aesthetic layer, the cushion layer, the suspension layer, and the seat frame are used in a seating application selected from the group consisting of an automotive seat, an airplane seat, a train seat, and a subway seat.

12. The double needle bar spacer knit fabric as set forth in claim 9, wherein the aesthetic layer and cushion layer are arranged such that the suspension layer is hidden from view by a user of the seating application.

13. The double needle bar spacer knit fabric as set forth in claim 9, wherein the suspension layer fully recovers to the initial position after the force is removed therefrom.

14. The double needle bar spacer knit fabric as set forth in claim 9, wherein the aesthetic layer is configured to stretch from an initial position when force is applied thereto by the weight of a user, wherein force applied by the weight of a user to the aesthetic layer is capable of being transferred to the suspension layer to cause stretching of the suspension layer, wherein recovery to the initial position of the suspension layer through removal of force applied to the aesthetic layer and the suspension layer by the weight of the user causes recovery of the aesthetic layer to the initial position of the aesthetic layer.

15. The double needle bar spacer knit fabric as set forth in claim 9, wherein all of the yarns of the suspension layer are elastomeric yarns, wherein at least some of the yarns of the cushion layer are polyester monofilament yarns, and wherein all of the yarns of the aesthetic layer are polyester yarns.

16. The double needle bar spacer knit fabric as set forth in claim 9, wherein the elastomeric yarns of the suspension layer are multi-filament elastomeric yarns, and wherein the cushion layer functions to separate the aesthetic layer and the suspension layer from one another so that a space is formed between the aesthetic layer and the suspension layer when the cushion layer is not compressed.

17. The double needle bar spacer knit fabric as set forth in claim 9, wherein the aesthetic layer is hydrophobic such that water is prevented from being absorbed through the aesthetic layer and into the cushion layer.

18. A double needle bar spacer knit fabric, comprising:

a first layer having a plurality of yarns that are multi-filament elastomeric yarns that function to impart stretch and recovery properties to the first layer;

a second layer having a plurality of yarns that are polyester yarns; and a connecting layer that has a plurality of traversing yarns that are polyester monofilament yarns that are connected to both the first layer and the second layer;

wherein application of a force to the first layer and the second layer causes stretching of the first layer from an initial position and causes stretching of the second layer from an initial position, wherein recovery of the first layer after removal of the force from the first layer and the second layer effects recovery of the second layer;

wherein the first layer, the second layer and the connection layer are made in a double needle bar construction.

* * * * *